US010020132B1

(12) United States Patent
Cortes Rico

(10) Patent No.: US 10,020,132 B1
(45) Date of Patent: Jul. 10, 2018

(54) TERMINAL BARRIERS FOR COVERING THE LUGS OR TERMINALS OF ELECTRICAL SWITCHING APPARATUS SUCH AS CIRCUIT BREAKERS

(71) Applicant: Siemnes Industry, Inc., Alpharetta, GA (US)

(72) Inventor: Gustavo Cortes Rico, Suwanee, GA (US)

(73) Assignee: SIEMENS INDUSTRY, INC., Alpharetta, GA (US)

( * ) Notice: Subject to any disclaimer, the term of this patent is extended or adjusted under 35 U.S.C. 154(b) by 0 days.

(21) Appl. No.: 15/603,846

(22) Filed: May 24, 2017

(51) Int. Cl.
*H01H 71/08* (2006.01)
*H01H 9/02* (2006.01)
*H01H 71/02* (2006.01)

(52) U.S. Cl.
CPC ..... *H01H 9/0264* (2013.01); *H01H 71/02* (2013.01)

(58) Field of Classification Search
CPC ..... H01H 71/08; H01H 2239/032
USPC ..... 335/202
See application file for complete search history.

(56) References Cited

U.S. PATENT DOCUMENTS 6,172,586 B1 * 1/2001 Ferree ..... H01H 71/08 335/202
6,838,962 B2 * 1/2005 Leone ..... H01H 9/342 335/16
8,159,321 B2 * 4/2012 Bollinger ..... H01H 50/045 200/243
8,698,023 B2 * 4/2014 Grunwald ..... H01H 9/0264 200/303
2007/0001791 A1 * 1/2007 Fischer ..... H01H 73/08 335/202
2013/0307650 A1 * 11/2013 Gerving ..... H01H 9/0264 335/202
2015/0129400 A1 * 5/2015 Oh ..... H01H 3/22 200/293

* cited by examiner

*Primary Examiner* — Gary Paumen

(57) ABSTRACT

A terminal barrier for covering an electrical terminal of an electrical switching apparatus having a housing is provided. The terminal barrier comprises a flexible portion that is configured to flexibly bend away from a rest position after the terminal barrier is installed. The terminal barrier further comprises a wall portion configured to surround the electrical terminal to block any access to the electrical terminal from one or more sides except an access for installation of a service line wire in the electrical terminal. The terminal barrier further comprises a snap portion for snapping in place around the electrical terminal to removably attach the terminal barrier to the housing of the electrical switching apparatus.

17 Claims, 9 Drawing Sheets

Section A-A

Section C-C

Section B-B

Section A-A

Section B-B

Section A-A

Section B-B

Section C-C

TERMINAL BARRIERS FOR COVERING THE LUGS OR TERMINALS OF ELECTRICAL SWITCHING APPARATUS SUCH AS CIRCUIT BREAKERS

BACKGROUND

1. Field

Aspects of the present invention generally relate to electrical switching apparatus such as circuit breakers and more specifically relate to terminal barriers for covering lugs or terminals of the electrical switching apparatus such as circuit breakers.

2. Description of the Related Art

Electrical switching apparatus, such as circuit breakers, may include one or more electrical line terminals to which one or more line field electrical wires may be connected. In three-phase circuit breakers, for example, three line terminals may be included. During installation of the line-side terminal connection(s), the one or more field wires may be stripped, inserted into the terminal socket(s), and secured in place with terminal screw(s).

A circuit breaker is a device designed to open and close a circuit by non-automatic means, and to open the circuit automatically on a predetermined over-current without damage to itself when properly applied within its rating. In operation, the circuit breaker ensures current interruption thereby providing protection to the electrical circuit from continuous over current conditions and high current transients due, for example, to electrical short circuits.

Service is the conductors and equipment for delivering electric energy from the serving utility to the wiring system of the premises served. Service equipment includes the necessary equipment, usually consisting of a circuit breaker (s) or switch(es) and fuse(s), and their accessories, connected to the load end of service conductors to a building or other structure, or an otherwise designated area, and intended to constitute the main control and cutoff of the supply.

Circuit breakers, either molded case, fused, or in combination with ground fault circuit interrupters, are suitable for use as service disconnects. Other devices that are used to protect individual circuits, circuits within equipment or appliances, or circuit protectors without on and off features, are not suitable for use as service disconnects. Each service disconnect provided must have a switching feature that disconnects all conductors from the service-entrance conductors and that is suitable for use as a service disconnect. Wire connectors (lugs) need to have the proper ratings for specific application, and the mounting hardware for wire connectors needs to be properly selected and attached with the correct torque.

To ensure worker safety there is a UL67 standard for Service Entrance Barriers. The UL67 standard guards against inadvertent contact with any exposed line side parts that could still be energized.

According to the Occupational Safety and Health Association there are more than 92 work-related deaths per week. A little over eight percent of those are caused by electrocution, most of which occur by inadvertent contact with energized objects. Accordingly, there is a need to protect persons inadvertently touching an electrically live component when a main switch or a circuit breaker is in an OFF position.

Therefore, there is a need for a terminal barrier in place that provides suitable terminal protection yet overcomes any problems of the prior art.

SUMMARY

Briefly described, aspects of the present invention relate to a terminal barrier to be set or snapped in place on a circuit breaker housing to cover a wire connector (lug) or an electrical terminal such that it provides suitable terminal protection. For example, the terminal barrier to prevent electrical shock. The line side of such circuit breakers may include a terminal barrier to prevent an installer/user/person from contacting any of the one or more stripped field wires and/or terminal screws at a wire connector (lug) or an electrical terminal.

In accordance with one illustrative embodiment of the present invention, a terminal barrier for covering an electrical terminal of an electrical switching apparatus having a housing is provided. The terminal barrier comprises a flexible portion that is configured to flexibly bend away from a rest position after the terminal barrier is installed. The terminal barrier further comprises a wall portion configured to surround the electrical terminal to block any access to the electrical terminal from one or more sides except an access for installation of a service line wire in the electrical terminal. The terminal barrier further comprises a snap portion for snapping in place around the electrical terminal to removably attach the terminal barrier to the housing of the electrical switching apparatus.

In accordance with another illustrative embodiment of the present invention, a terminal barrier for covering an electrical terminal of an electrical switching apparatus is provided. The terminal barrier comprises a flexible portion that is configured to flexibly move to open up an access space that allows installation of a service line wire in the electrical terminal. The terminal barrier further comprises a wall portion coupled to the flexible portion, the wall portion having one or more openings to allow free flow of air. The wall portion to surround the electrical terminal. The terminal barrier further comprises a snap portion coupled to the wall portion, the snap portion configured to removably snap in place around the electrical terminal. The snap portion to interface with the flexible portion and the wall portion to form a shield configured for shielding around the service line wire extendable from the electrical terminal such that a finger-sized probe is not able to touch any live parts when the terminal barrier is installed and the electrical terminal is energized.

In accordance with another illustrative embodiment of the present invention, a method of covering an electrical terminal of an electrical switching apparatus having a housing with a line terminal barrier is provided. The method comprises providing a flexible portion of the line terminal barrier that is configured to flexibly bend away from a rest position after the terminal barrier is installed, providing a wall portion of the line terminal barrier configured to surround the electrical terminal to block any access to the electrical terminal from one or more sides except an access for installation of a service line wire in the electrical terminal and providing a snap portion of the line terminal barrier for snapping in place around the electrical terminal to removably attach the terminal barrier to the housing of the electrical switching apparatus. The snap portion to interface with the flexible portion and the wall portion to form a shield configured for shielding around the service line wire extendable from the electrical terminal such that a finger-sized probe is not able to touch any live parts when the terminal barrier is installed and the electrical terminal is energized.

DETAILED DESCRIPTION

To facilitate an understanding of embodiments, principles, and features of the present invention, they are explained hereinafter with reference to implementation in illustrative embodiments. In particular, they are described in the context of being a line terminal barrier provided for shielding or covering an electrical terminal of an electrical switching apparatus. Embodiments of the present invention, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present invention.

Figure 1:
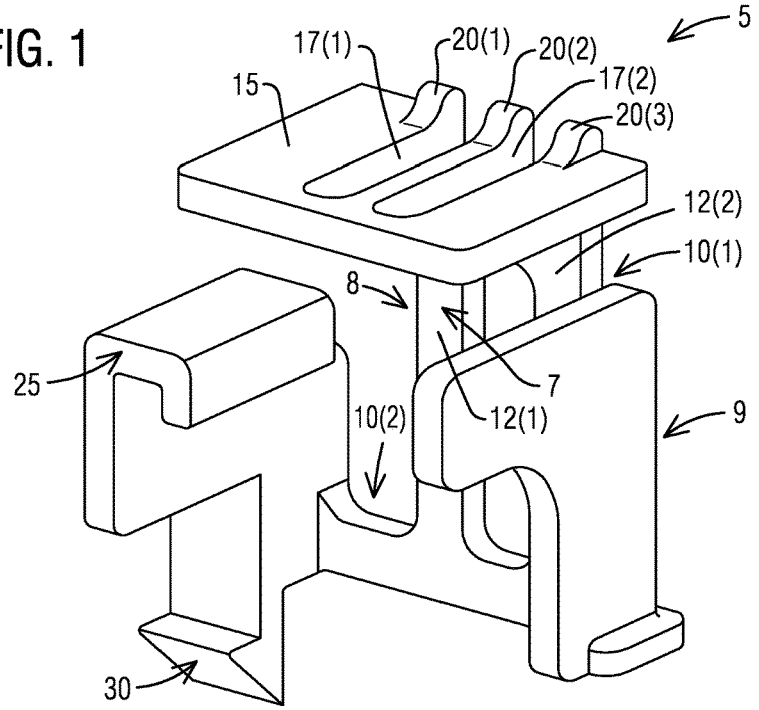
FIG. 1 illustrates a perspective view of a line terminal barrier in accordance with an exemplary embodiment of the present invention.

Consistent with one embodiment of the present invention, FIG. 1 represents a perspective view of a line terminal barrier 5 in accordance with an exemplary embodiment of the present invention. The line terminal barrier 5 is provided for shielding an electrical terminal (not shown) of an electrical switching apparatus having a housing. The line terminal barrier 5 may be made of thermoplastic or thermoset materials. Thermoset plastics are synthetic materials that strengthen during being heated, but cannot be successfully remolded or reheated after their initial heat-forming. This is in contrast to thermoplastics, which soften when heated and harden and strengthen after cooling. A thermoplastic is a plastic material or a polymer that becomes pliable or moldable above a specific temperature and solidifies upon cooling. In addition, polyurethanes can be thermoplastic or thermoset. The properties of polyurethanes can be changed by varying the type or quantity of three basic substances of their production: diisocyanate, short-chain diol and long-chain diol.

Examples of the electrical switching apparatus include a circuit breaker such as molded case, fused, or in combination with ground fault circuit interrupters that are suitable for use as service disconnects. A circuit breaker is an automatic device for stopping the flow of current in an electric circuit as a safety measure. For example, a circuit breaker is an automatically operated electrical switch designed to protect an electrical circuit from damage caused by excess current, typically resulting from an overload or short circuit. Its basic function is to interrupt current flow after a fault is detected. Unlike a fuse, which operates once and then must be replaced, a circuit breaker can be reset (either manually or automatically) to resume normal operation.

The line terminal barrier 5 comprises a flexible portion 7 that is configured to flexibly bend away from a rest position after the line terminal barrier 5 is installed. The flexible portion 7 is configured to flexibly move to open up an access space 8 that allows installation of a service line wire (not shown) in the electrical terminal.

The line terminal barrier 5 further comprises a wall portion 9 configured to surround the electrical terminal to block any access to the electrical terminal from one or more sides except an access for installation of a service line wire (not shown) in the electrical terminal. The wall portion 9 has first and second openings 10(1-2) to allow a free flow of air. The wall portion 9 includes first and second flexible arms 12(1-2) to allow access to a set screw (not shown). The wall portion further includes a cover 15 with one or more ventilators 17(1-2) and a plurality of grip ribs 20(1-3). The wall portion further includes a U-shaped hold feature 25 to latch on to the electrical terminal.

The line terminal barrier 5 further comprises a snap portion 30 for snapping in place around the electrical terminal to removably attach the line terminal barrier 5 to the housing of the electrical switching apparatus. The snap portion 30 is located underneath the U-shaped hold feature 25. The snap portion 30 is configured to interface with the flexible portion 7 and the wall portion 9 to form a shield configured for shielding around the service line wire extendable from the electrical terminal such that a finger-sized probe is not able to touch any live parts when the line terminal barrier 5 is installed and the electrical terminal is energized.

To ensure worker safety the line terminal barrier 5 of FIG. 1 follows the UL67 standard for Service Entrance Barriers. The line terminal barrier 5 of FIG. 1 can prevent work-related deaths per week such as those are caused by electrocution, most of which occur by inadvertent contact with energized objects. The line terminal barrier 5 of FIG. 1 guards against inadvertent contact with any exposed line side parts that could still be energized. Accordingly, line terminal barrier 5 of FIG. 1 protects persons inadvertently touching an electrically live component when a main switch or a circuit breaker is in an OFF position.

As used herein, "a line terminal barrier" refers to a terminal barrier to be set or snapped in place on a circuit breaker housing to cover a wire connector (lug) or an electrical terminal such that it provides suitable terminal protection which prevents an installer/user/person from contacting any of the one or more stripped field wires and/or terminal screws. The line terminal barrier can include multiple interacting portions, whether located together or apart, that together perform processes as described herein.

The techniques described herein can be particularly useful for using a wire connector (lug) or an electrical terminal of an electrical switching apparatus such as a circuit breaker. While particular embodiments are described in terms of the line terminal barrier for the circuit breakers, the techniques described herein are not limited to the line terminal barrier but can also be used at load terminals and for other electrical equipment where protection from electrical shock due to possible live parts at a terminal is desired.

Figure 2:
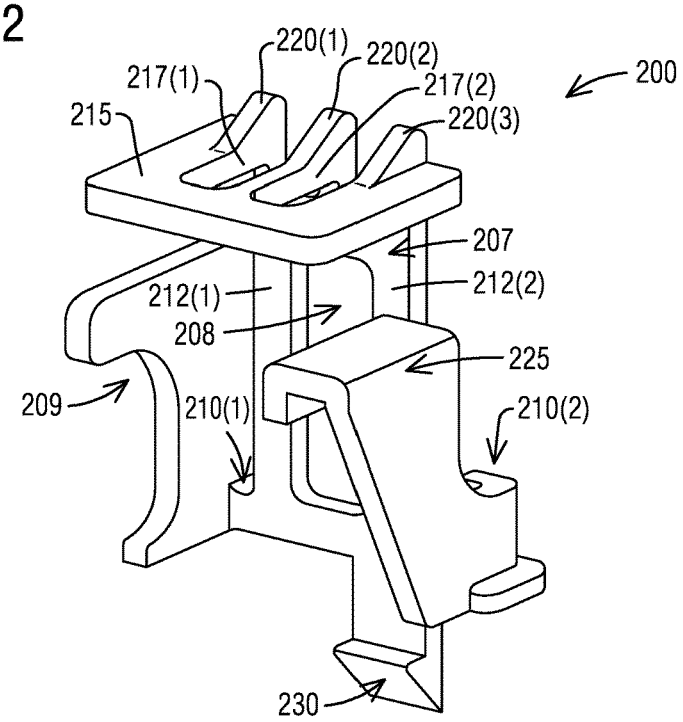
FIG. 2 illustrates a perspective view of a line terminal barrier in accordance with another exemplary embodiment of the present invention.

Referring to FIG. 2, it illustrates a perspective view of a line terminal barrier 200 in accordance with another exemplary embodiment of the present invention. The line terminal barrier 200 is provided for shielding an electrical terminal (not shown) of an electrical switching apparatus having a housing.

The line terminal barrier 200 comprises a flexible portion 207 that is configured to flexibly bend away from a rest position after the line terminal barrier 200 is installed. The flexible portion 207 is configured to flexibly move to open up an access space 208 that allows installation of a service line wire (not shown) in the electrical terminal.

The line terminal barrier 200 further comprises a wall portion 209 configured to surround the electrical terminal to block any access to the electrical terminal from one or more sides except an access for installation of a service line wire (not shown) in the electrical terminal. The wall portion 209 has first and second openings 210(1-2) to allow a free flow of air. The wall portion 209 includes first and second flexible arms 212(1-2) to allow access to a set screw (not shown). The wall portion further includes a cover 215 with one or more ventilators 217(1-2) and a plurality of grip ribs 220 (1-3). The wall portion further includes a U-shaped hold feature 225 to latch on to the electrical terminal.

The line terminal barrier 200 further comprises a snap portion 230 for snapping in place around the electrical terminal to removably attach the line terminal barrier 200 to the housing of the electrical switching apparatus. The snap portion 230 is not located underneath the U-shaped hold feature 225 but is set offset from it such that it is aligned with a back wall of the flexible portion 207. The snap portion 230 is configured to interface with the flexible portion 207 and the wall portion 209 to form a shield configured for shielding around the service line wire extendable from the electrical terminal such that a finger-sized probe is not able to touch any live parts when the line terminal barrier 200 is installed and the electrical terminal is energized.

To ensure worker safety the line terminal barrier 200 of FIG. 2 follows the UL67 standard for Service Entrance Barriers. The line terminal barrier 200 of FIG. 2 can prevent work-related deaths per week such as those are caused by electrocution, most of which occur by inadvertent contact with energized objects. The line terminal barrier 200 of FIG.

2 guards against inadvertent contact with any exposed line side parts that could still be energized. Accordingly, line terminal barrier 200 of FIG. 2 protects persons inadvertently touching an electrically live component when a main switch or a circuit breaker is in an OFF position.

Figure 3:
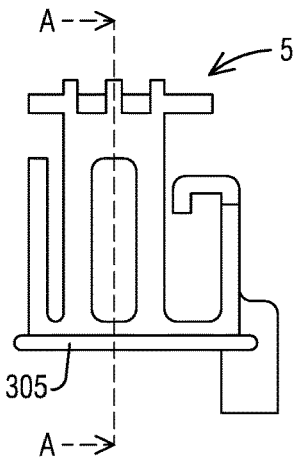
FIG. 3 illustrates a back view of the line terminal barrier of FIG. 1 in accordance with another exemplary embodiment of the present invention.

Turning now to FIG. 3, it illustrates a back view of the line terminal barrier 5 of FIG. 1 in accordance with another exemplary embodiment of the present invention. The snap portion 30 is located underneath the U-shaped hold feature 25. The snap portion 30 extends below a base portion 305 of the line terminal barrier 5. The flexible portion 7 rises near perpendicular to the base portion 305. The cover 15 of the wall portion 9 is configured transverse to the flexible portion 7. On the cover 15 the ventilators 17(1-2) and the plurality of grip ribs 20(1-3) are longitudinally aligned with a length of the cover 15.

Figure 4:
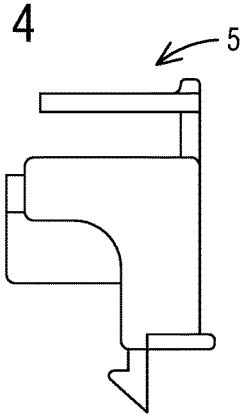
FIG. 4 illustrates a left view of the line terminal barrier of FIG. 3 in accordance with another exemplary embodiment of the present invention.

FIG. 4 illustrates a left view of the line terminal barrier 5 of FIG. 3 in accordance with another exemplary embodiment of the present invention. The U-shaped hold feature 25 but is set partially under the cover 15 and the U-shape faces downwards and away from the cover 15. The U-shaped hold feature 25 has a height from the base portion 305 which less than a height of the cover 15 from the base portion 305. The cover 15 and the U-shaped hold feature 25 extends horizontally away from the flexible portion 7 at two different planes in that a flat surface of the back of the U-shape of the U-shaped hold feature 25 being on a lower plane from the base portion 305.

Figure 5:
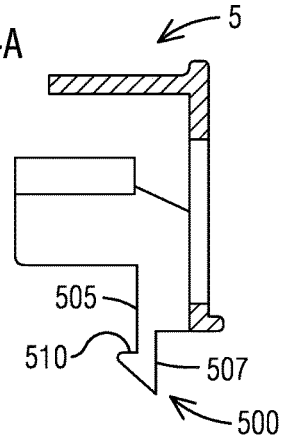
FIG. 5 illustrates a cross sectional view of the line terminal barrier of FIG. 3 at a cross section A-A in accordance with another exemplary embodiment of the present invention.

As seen in FIG. 5, it illustrates a cross sectional view of the line terminal barrier 5 of FIG. 3 at a cross section A-A in accordance with another exemplary embodiment of the present invention. The cover 15 and the flexible portion 7 have almost same thickness. The snap portion 30 is located offset from the flexible portion 7.

In one embodiment, the snap portion 30 has a wedge 500 configured to latch on to the housing of the circuit breaker. The wedge 500 has a downwardly extending projection 505 having a latching portion 507 with a frictionally engaging surface 510. The wedge 500 is being urged to latch on from engagement with the housing when contacted by the frictionally engaging surface 510 of the downwardly extending projection 505. The downwardly extending projection 505 is urged around a body portion of the housing to cause the downwardly extending projection 505 to close around the body portion of the housing with the help of the latching portion 507.

Figure 6:
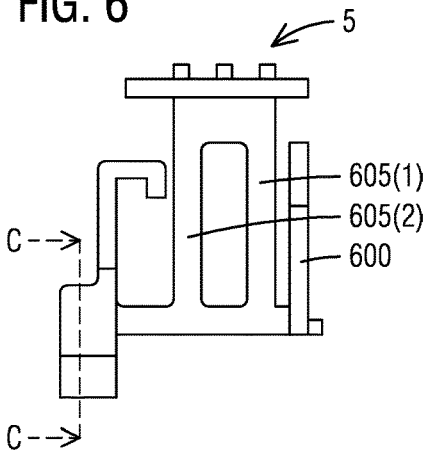
FIG. 6 illustrates a front view of the line terminal barrier of FIG. 1 in accordance with another exemplary embodiment of the present invention.

As shown in FIG. 6, it illustrates a front view of the line terminal barrier 5 of FIG. 1 in accordance with another exemplary embodiment of the present invention. As can be seen, the flexible portion 7 is shaped and sized such that it for the most part fits in a gap between a wall 600 of the wall portion 9 and the U-shaped hold feature 25. The flexible portion 7 includes first and second members 605(1-2) that provide resilience to the flexible portion 7. The line terminal barrier 5 is inserted onto the housing of the circuit breaker facing a front side visible in this view.

Figure 7:
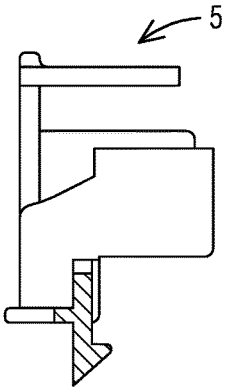
FIG. 7 illustrates a cross sectional view of the line terminal barrier of FIG. 6 at a cross section C-C in accordance with another exemplary embodiment of the present invention.

In FIG. 7, it illustrates a cross sectional view of the line terminal barrier 5 of FIG. 6 at a cross section C-C in accordance with another exemplary embodiment of the present invention. The downwardly extending projection 505 moves forward to latch onto a latching portion of a projection of the housing thereby automatically clamping the snap portion 30 onto the body structure of the circuit breaker. The frictionally engaging surface 510 moves against the latching portion of a projection of the housing.

Figure 8:
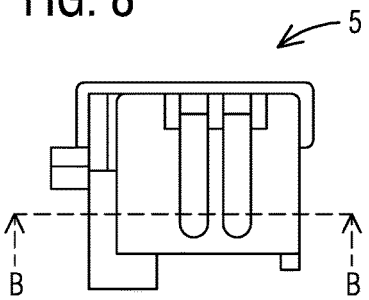
FIG. 8 illustrates a top view of the line terminal barrier of FIG. 1 in accordance with another exemplary embodiment of the present invention.
Figure 9:
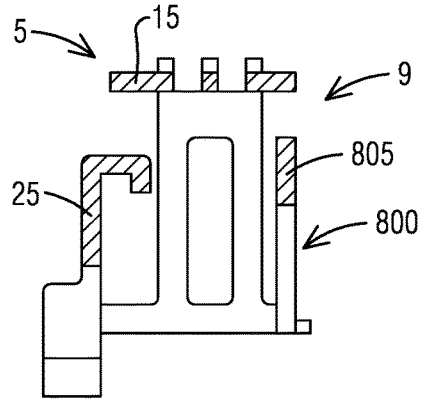
FIG. 9 illustrates a cross sectional view of the line terminal barrier of FIG. 8 at a cross section B-B in accordance with another exemplary embodiment of the present invention.

FIG. 8 illustrates a top view of the line terminal barrier 5 of FIG. 1 in accordance with another exemplary embodiment of the present invention. FIG. 9 illustrates a cross sectional view of the line terminal barrier 5 of FIG. 8 at a cross section B-B in accordance with another exemplary embodiment of the present invention. The cover 15, the wall portion 9 and the U-shaped hold feature 25 have almost same thickness. The wall portion 9 includes a longitudinal recess 800 in a wall 805 to accommodate a service wire.

Figure 10:
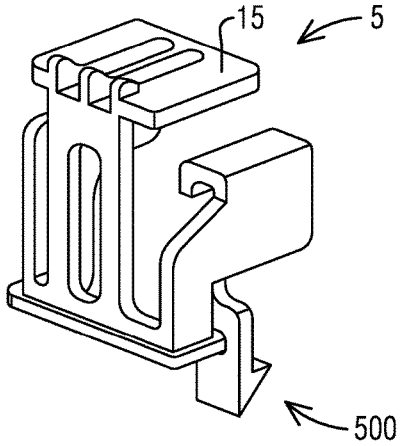
FIG. 10 illustrates another perspective view of the line terminal barrier of FIG. 1 in accordance with an exemplary embodiment of the present invention.

FIG. 10 illustrates another perspective view from back of the line terminal barrier 5 of FIG. 1 in accordance with an exemplary embodiment of the present invention. The cover 15 and the wedge 500 cooperate with each other to maintain a clamping force in a latched position and maintain their contact with each other such that the line terminal barrier 5 satisfactorily interlocks with the housing of the circuit breaker when the line terminal barrier 5 is non-fixedly mounted at the electrical terminal or the lug.

Figure 11:
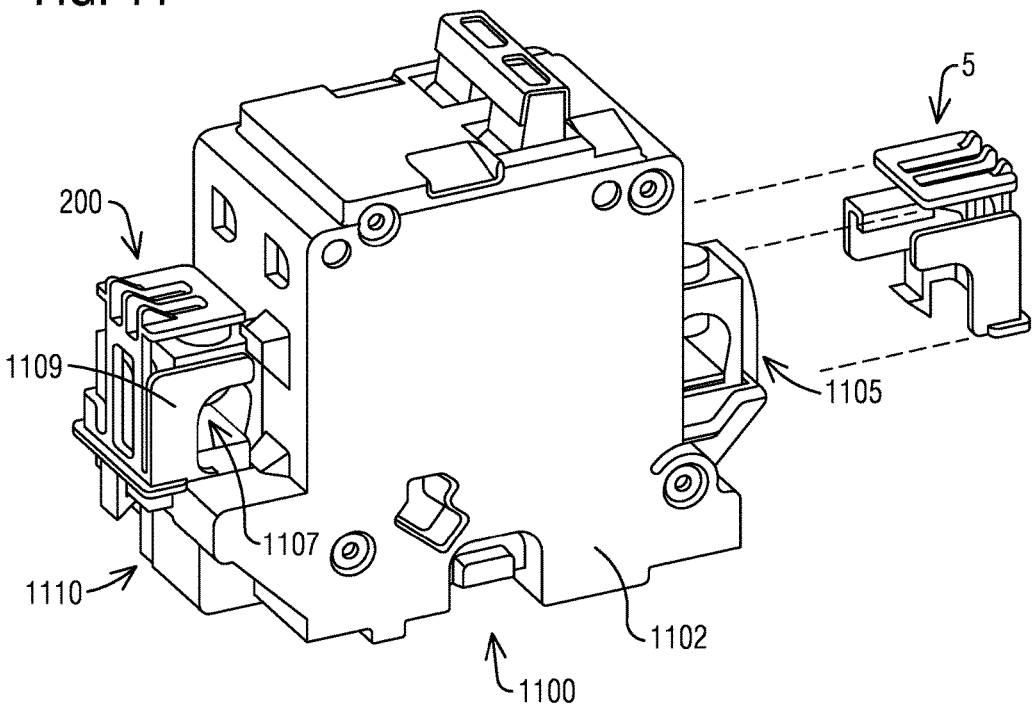
FIG. 11 illustrates a perspective view of the line terminal barrier of FIG. 1 ready to be hooked onto an electrical switching apparatus such as a circuit breaker to cover a wire connector (lug) or an electrical terminal in accordance with an exemplary embodiment of the present invention.

FIG. 11 illustrates a perspective view of the line terminal barrier 5 of FIG. 1 ready to be hooked onto an electrical switching apparatus such as a circuit breaker 1100 having a housing 1102 to cover a wire connector (lug) or an electrical terminal 1105 in accordance with an exemplary embodiment of the present invention. The general purpose of the electrical terminal 1105 is to conductively receive and clamp in its socket one or more line terminal wires. The electrical terminal 1105 may have a tubular wire socket open at least at one end and having a first opening on one side of the socket adjacent the end and also having a second opening on the other side adjacent the other end. This tubular wire socket provides a passageway for reception of a wire or wires. A set screw is threaded through an opening on the top of the electrical terminal 1105 and is located adjacent to the first end and the second end. With such a set screw arrangement, a large range of wire sizes and numbers to be accommodated in the tubular wire socket.

In one embodiment, the electrical terminal 1105 may be a line terminal. The line terminal is the point at which a conductor or a wire from an electrical component, device or network comes to an end and provides a point of connection to external circuits. The line terminal may simply be the end of a wire and it is fitted with a connector or a fastener having a set screw. The line terminal may a recess on two sides to insert the conductor or the wire. The line terminal includes a wire receiving socket. The set screw provides for convenient acceptance of a large range of wire diameters. The tightening of the set screw installs the conductor or the wire in the wire receiving socket at the electrical terminal 1105. The connection is temporary and requires a tool for assembly and removal.

FIG. 11 further illustrates a perspective view of the line terminal barrier 200 of FIG. 2 hooked onto the electrical switching apparatus such as the circuit breaker 1100 having the housing 1102 to cover a wire connector (lug) or an electrical terminal 1110 in accordance with an exemplary embodiment of the present invention. A wall portion 1109 includes a recess 1107 to allow a reception of a wire or wires in a tubular wire socket of the electrical terminal 1110. The recess 1107 provides access to the tubular wire socket from a side in order to receive the wire or wires in a wire receiving socket, i.e., the tubular wire socket at the electrical terminal 1110.

Figure 12:
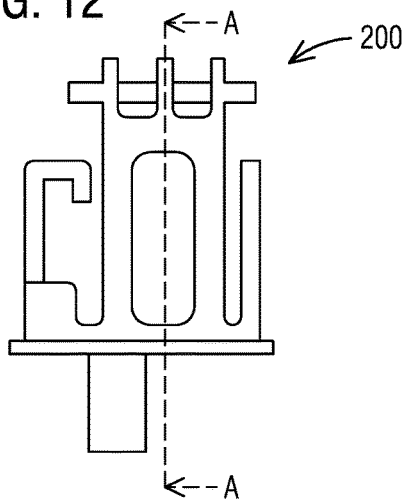
FIG. 12 illustrates a back view of the line terminal barrier of FIG. 2 in accordance with another exemplary embodiment of the present invention.
Figure 13:
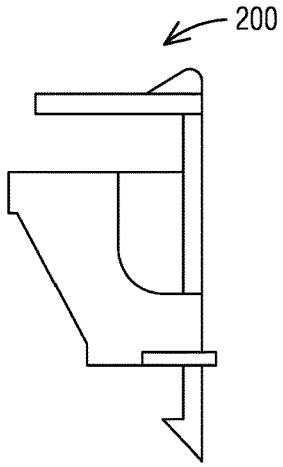
FIG. 13 illustrates a left view of the line terminal barrier of FIG. 12 in accordance with another exemplary embodiment of the present invention.
Figure 14:
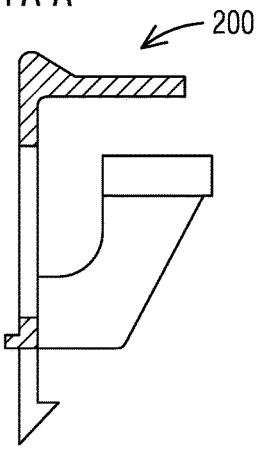
FIG. 14 illustrates a cross sectional view of the line terminal barrier of FIG. 12 at a cross section A-A in accordance with another exemplary embodiment of the present invention.
Figure 15:
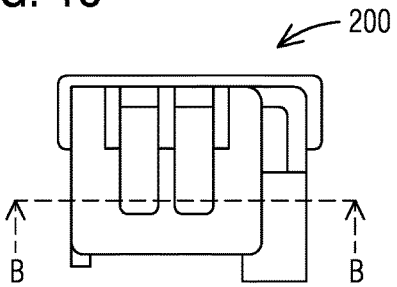
FIG. 15 illustrates a top view of the line terminal barrier of FIG. 2 in accordance with another exemplary embodiment of the present invention.
Figure 16:
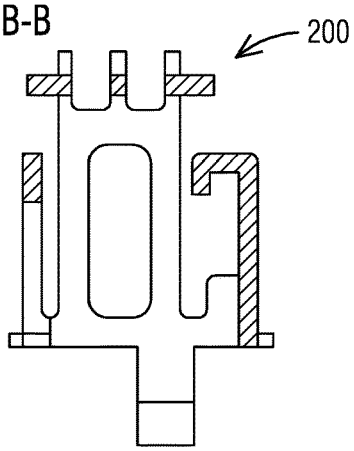
FIG. 16 illustrates a cross sectional view of the line terminal barrier of FIG. 15 at a cross section B-B in accordance with another exemplary embodiment of the present invention.
Figure 17:
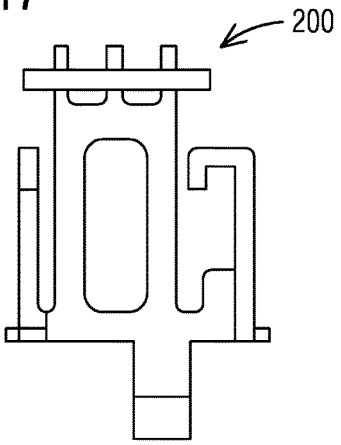
FIG. 17 illustrates a front view of the line terminal barrier of FIG. 2 in accordance with another exemplary embodiment of the present invention.
Figure 18:
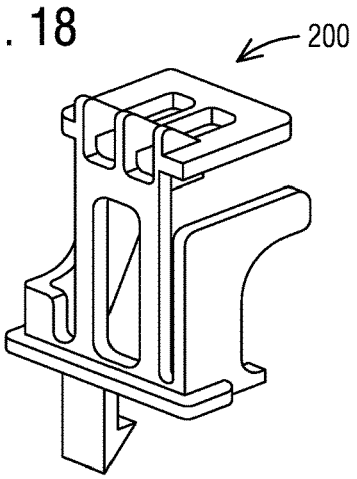
FIG. 18 illustrates another perspective view of the line terminal barrier of FIG. 2 in accordance with an exemplary embodiment of the present invention.
Figure 19:
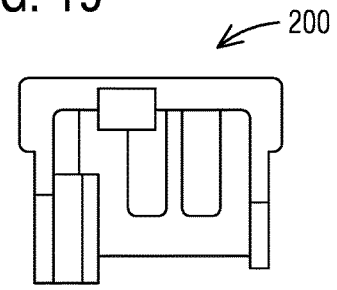
FIG. 19 illustrates a bottom view of the line terminal barrier of FIG. 2 in accordance with another exemplary embodiment of the present invention.

FIG. 12 illustrates a back view of the line terminal barrier 200 of FIG. 2 in accordance with another exemplary embodiment of the present invention. FIG. 13 illustrates a left view of the line terminal barrier 200 of FIG. 12 in accordance with another exemplary embodiment of the present invention. FIG. 14 illustrates a cross sectional view of the line terminal barrier 200 of FIG. 12 at a cross section A-A in accordance with another exemplary embodiment of the present invention. FIG. 15 illustrates a top view of the line terminal barrier 200 of FIG. 2 in accordance with another exemplary embodiment of the present invention. FIG. 16 illustrates a cross sectional view of the line terminal barrier 200 of FIG. 15 at a cross section B-B in accordance with another exemplary embodiment of the present invention. FIG. 17 illustrates a front view of the line terminal barrier 200 of FIG. 2 in accordance with another exemplary embodiment of the present invention. FIG. 18 illustrates another perspective view of the line terminal barrier 200 of FIG. 2 in accordance with an exemplary embodiment of the present invention. FIG. 19 illustrates a bottom view of the line terminal barrier 200 of FIG. 2 in accordance with another exemplary embodiment of the present invention.

Figure 20:
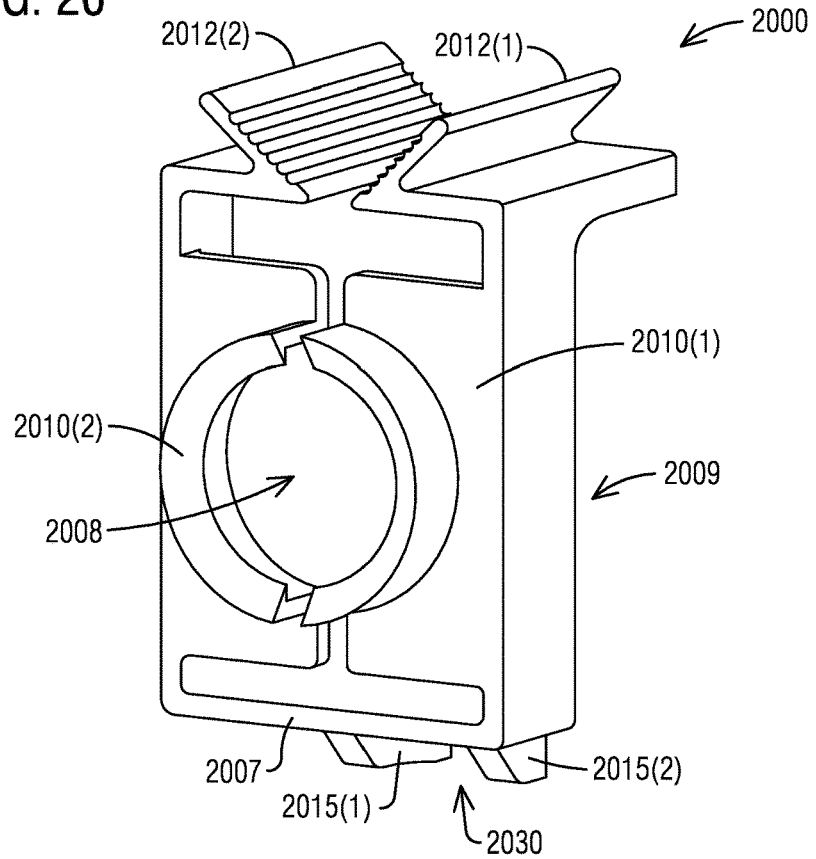
FIG. 20 illustrates a perspective view of a line terminal barrier in accordance with yet another exemplary embodiment of the present invention.

FIG. 20 illustrates a perspective view of a line terminal barrier 2000 in accordance with yet another exemplary embodiment of the present invention. The line terminal barrier 2000 comprises a flexible portion 2007 that is configured to flexibly bend away from a rest position after the line terminal barrier 2000 is installed. The flexible portion 2007 is configured to flexibly stretch to open up an access space 2008 that allows installation of a service line wire (not shown) in the electrical terminal.

The line terminal barrier 2000 further comprises a wall portion 2009 configured to surround the electrical terminal to block any access to the electrical terminal from one or more sides except an access for installation of a service line wire (not shown) in the electrical terminal. The wall portion 2009 has first and second walls 2010(1-2) that flex-in and flex-out to allow installation of a service line wire. The wall portion 2009 includes first and second grips 2012(1-2) to open the line terminal barrier 2000 from its top to allow installation of the line terminal barrier 2000 before or after the service line wire is in place. The first and second grips 2012(1-2) to allow access to a set screw (not shown).

The line terminal barrier 2000 further comprises a snap portion 2030 for snapping in place around the electrical terminal to removably attach the line terminal barrier 2000 to the housing of the electrical switching apparatus. The snap portion 2030 includes first and second snapping legs 2015(1-2) to latch on to a boss of the housing of the electrical switching apparatus. The snap portion 2030 is located underneath the wall portion 2009.

The flexible portion 2007 is configured to interface with and the wall portion 2009 to form a shield configured for shielding around the service line wire extendable from the electrical terminal such that a finger-sized probe is not able to touch any live parts when the line terminal barrier 5 is installed and the electrical terminal is energized.

To ensure worker safety the line terminal barrier 2000 of FIG. 20 follows the UL67 standard for Service Entrance Barriers. The line terminal barrier 2000 of FIG. 20 can prevent work-related deaths per week such as those are caused by electrocution, most of which occur by inadvertent contact with energized objects. The line terminal barrier 2000 of FIG. 20 guards against inadvertent contact with any exposed line side parts that could still be energized. Accordingly, line terminal barrier 2000 of FIG. 20 protects persons inadvertently touching an electrically live component when a main switch or a circuit breaker is in an OFF position.

Figure 21:
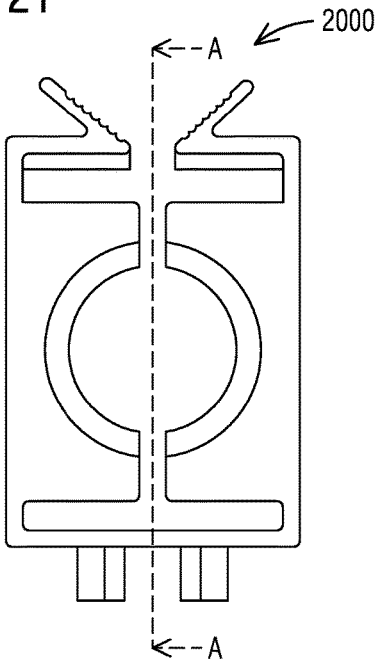
FIG. 21 illustrates a back view of the line terminal barrier of FIG. 20 in accordance with an exemplary embodiment of the present invention.
Figure 22:
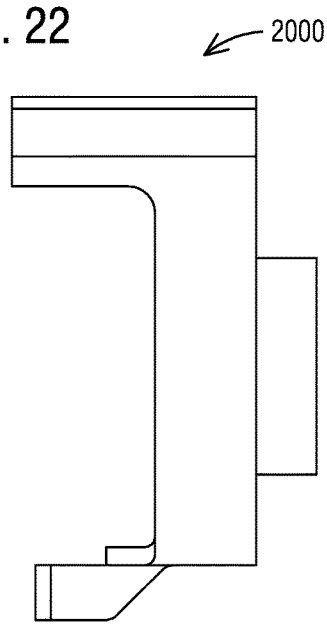
FIG. 22 illustrates a left view of the line terminal barrier of FIG. 20 in accordance with an exemplary embodiment of the present invention.
Figure 23:
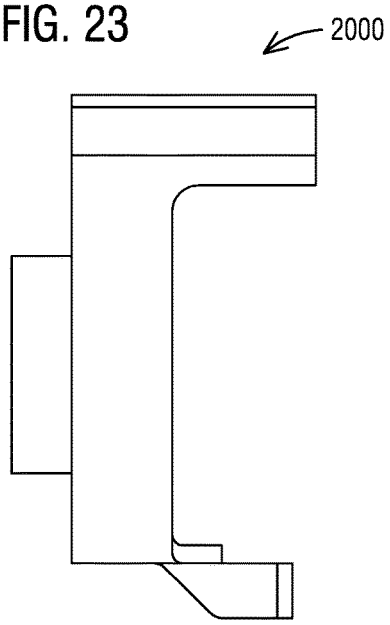
FIG. 23 illustrates a right view of the line terminal barrier of FIG. 20 in accordance with an exemplary embodiment of the present invention.
Figure 24:
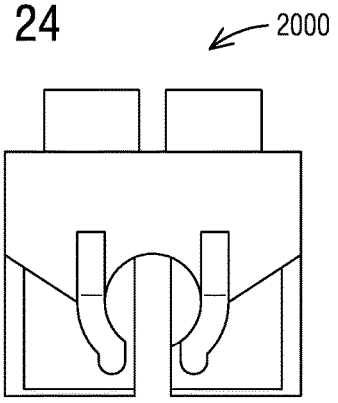
FIG. 24 illustrates a bottom view of the line terminal barrier of FIG. 20 in accordance with an exemplary embodiment of the present invention.
Figure 25:
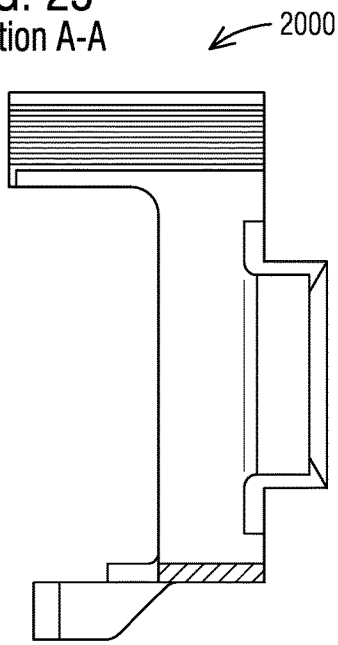
FIG. 25 illustrates a cross sectional view of the line terminal barrier of FIG. 21 at a cross section A-A in accordance with an exemplary embodiment of the present invention.
Figure 26:
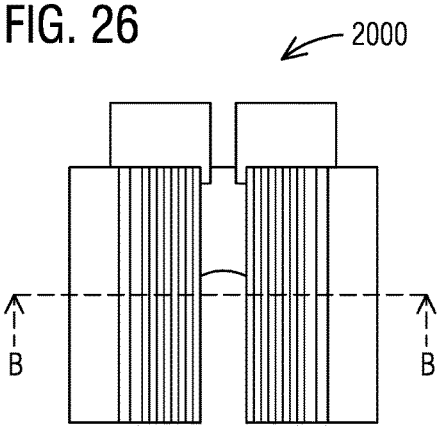
FIG. 26 illustrates a top view of the line terminal barrier of FIG. 20 in accordance with an exemplary embodiment of the present invention.
Figure 27:
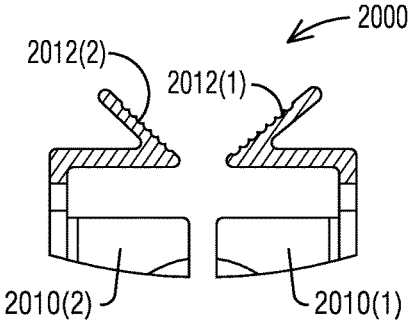
FIG. 27 illustrates a cross sectional view of the line terminal barrier of FIG. 26 at a cross section B-B in accordance with an exemplary embodiment of the present invention.
Figure 28:
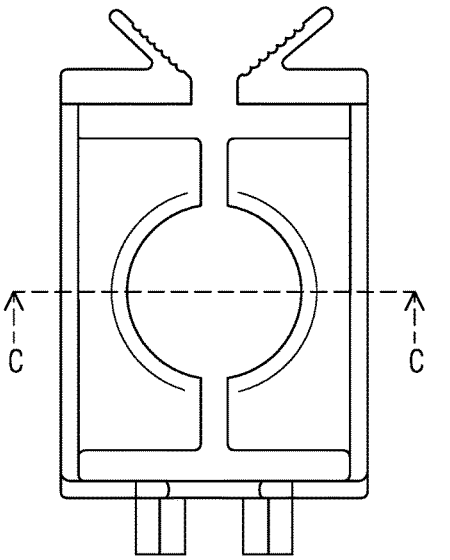
FIG. 28 illustrates a front view of the line terminal barrier of FIG. 20 in accordance with an exemplary embodiment of the present invention.
Figure 29:
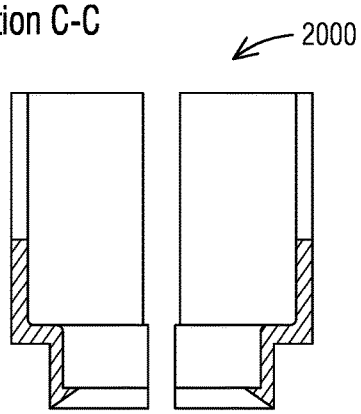
FIG. 29 illustrates a cross sectional view of the line terminal barrier of FIG. 28 at a cross section C-C in accordance with an exemplary embodiment of the present invention.
Figure 30:
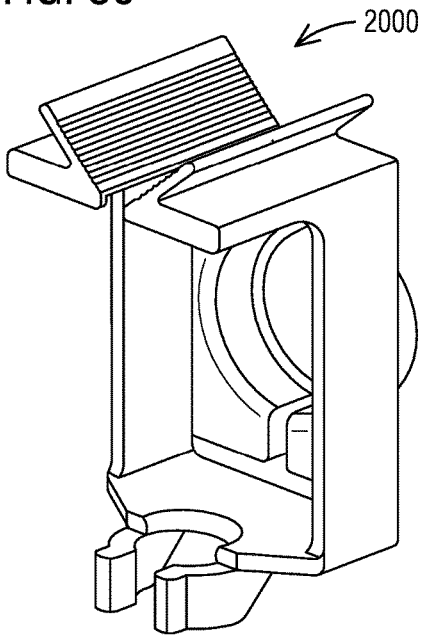
FIG. 30 illustrates another perspective view of the line terminal barrier of FIG. 20 in accordance with an exemplary embodiment of the present invention.

FIG. 21 illustrates a back view of the line terminal barrier 2000 of FIG. 20 in accordance with an exemplary embodiment of the present invention. FIG. 22 illustrates a left view of the line terminal barrier 2000 of FIG. 20 in accordance with an exemplary embodiment of the present invention. FIG. 23 illustrates a right view of the line terminal barrier 2000 of FIG. 20 in accordance with an exemplary embodiment of the present invention. FIG. 24 illustrates a bottom view of the line terminal barrier 2000 of FIG. 20 in accordance with an exemplary embodiment of the present invention. FIG. 25 illustrates a cross sectional view of the line terminal barrier 2000 of FIG. 21 at a cross section A-A in accordance with an exemplary embodiment of the present invention. FIG. 26 illustrates a top view of the line terminal barrier 2000 of FIG. 20 in accordance with an exemplary embodiment of the present invention. FIG. 27 illustrates a cross sectional view of the line terminal barrier 2000 of FIG. 26 at a cross section B-B in accordance with an exemplary embodiment of the present invention. FIG. 28 illustrates a front view of the line terminal barrier 2000 of FIG. 20 in accordance with an exemplary embodiment of the present invention. FIG. 29 illustrates a cross sectional view of the line terminal barrier 2000 of FIG. 28 at a cross section C-C in accordance with an exemplary embodiment of the present invention. FIG. 30 illustrates another perspective view of the line terminal barrier 2000 of FIG. 20 in accordance with an exemplary embodiment of the present invention.

Figure 31:
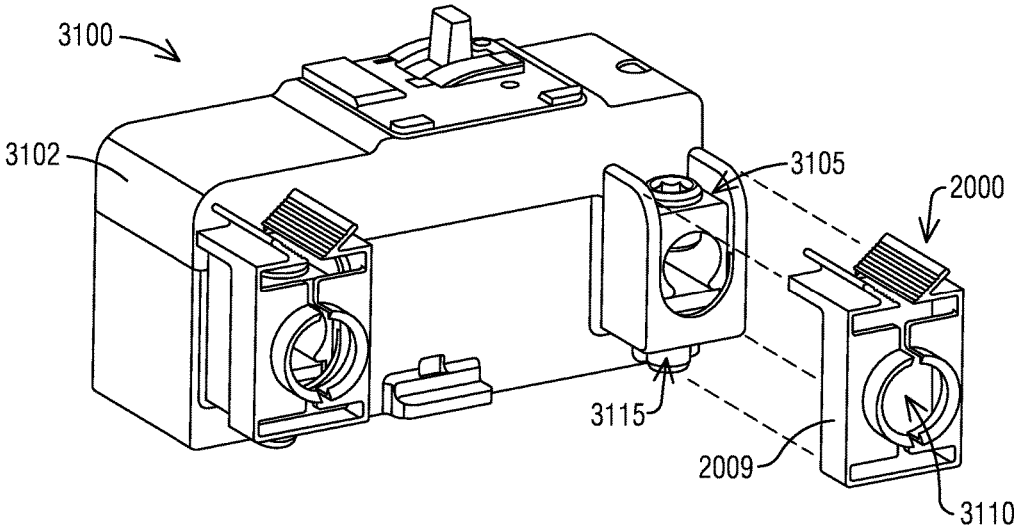
FIG. 31 illustrates a perspective view of the line terminal barrier of FIG. 20 ready to be hooked onto an electrical switching apparatus such as a circuit breaker to cover a wire connector (lug) or an electrical terminal in accordance with an exemplary embodiment of the present invention.

FIG. 31 illustrates a perspective view of the line terminal barrier 2000 of FIG. 20 ready to be hooked onto an electrical switching apparatus such as a circuit breaker 3100 having a housing 3102 to cover a wire connector (lug) or an electrical terminal 3105 in accordance with an exemplary embodiment of the present invention. The wall portion 2009 includes a recess 3110 to allow a reception of a wire or wires in a tubular wire socket of the electrical terminal 3105. The recess 3110 provides access to the tubular wire socket from a side in order receive the wire in a wire receiving socket, i.e., the tubular wire socket at the electrical terminal 3105.

By aligning the line terminal barrier 2000 with the electrical terminal 3105 and snapping onto a plastic boss 3115 on the bottom of the housing 3102 of the circuit breaker 3100 the line terminal barrier 2000 may cover the electrical terminal 3105. The top part of the line terminal barrier 2000 opens up to allow installation before or after wire is in place.

Figure 32:
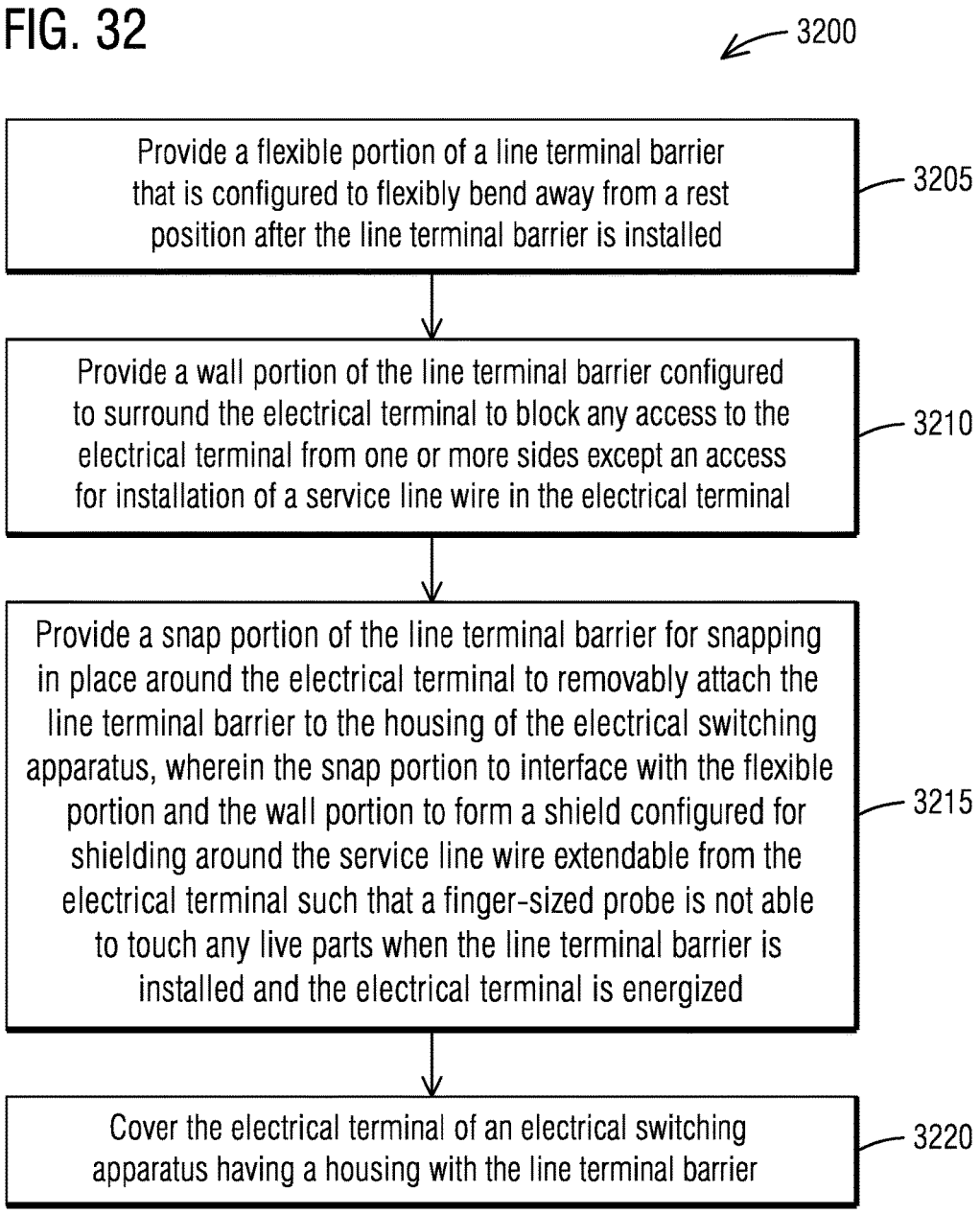
FIG. 32 illustrates a flow chart of a method of shielding an electrical terminal of an electrical switching apparatus having a housing according to an exemplary embodiment of the present invention.

FIG. 32 illustrates a flow chart of a method 3200 of shielding an electrical terminal of an electrical switching apparatus having a housing according to an exemplary embodiment of the present invention. Reference is made to the elements and features described in FIGS. 1-31. It should be appreciated that some steps are not required to be performed in any particular order, and that some steps are optional.

The method 3200, in step 3205, includes providing a flexible portion of a line terminal barrier that is configured to flexibly bend away from a rest position after the terminal barrier is installed. The method 3200, in step 3210, further includes providing a wall portion of the line terminal barrier configured to surround the electrical terminal to block any access to the electrical terminal from one or more sides except an access for installation of a service line wire in the electrical terminal. The method 3200, in step 3215 further includes providing a snap portion of the line terminal barrier for snapping in place around the electrical terminal to removably attach the terminal barrier to the housing of the electrical switching apparatus. The snap portion is configured to interface with the flexible portion and the wall portion to form a shield configured for shielding around the service line wire extendable from the electrical terminal such that a finger-sized probe is not able to touch any live parts when the terminal barrier is installed and the electrical terminal is energized. The method 3200, in step 3220 further includes covering an electrical terminal of an electrical switching apparatus having a housing with the line terminal barrier.

The flexible portion is configured to flexibly move to open up an access space that allows installation of a service line wire in the electrical terminal and wherein the wall portion having one or more openings to allow a free flow of air. The snap portion to interface with the flexible portion and the wall portion to form a shield configured for shielding around the service line wire extendable from the electrical terminal such that a finger-sized probe is not able to touch any live parts when the terminal barrier is installed and the electrical terminal is energized.

The snap-connect features may include a configuration where one feature interacts with another feature to provide some level of retention. A fit may be such that the line terminal barrier 5 may be removable to allow inspection of the wired connection to the electrical terminal. Terminal access region may allow access and insertion of a tool (e.g., a screwdriver, hex or square head tool, star tool, or the like) to tighten a terminal screw into a line terminal block. It should be understood that the line terminal barrier 5 may be used in some installations, i.e., to provide a shielding barrier for load side electrical terminals.

The electrical switching apparatus includes a housing, which may be a molded case housing that may be made from any suitable molded plastic material, for example. The plastic material may be a thermoset material, such as a glass-filled polyester, or a thermoplastic material such as a Nylon material (e.g., Nylon 6), for example. Other suitable housing materials may be used. Flame retardant materials may be compounded into the plastic in some embodiments. Conventional circuit breaker components may include the electrical contact assembly, tripping mechanism, load terminal(s), a bimetal assembly, a latch, and a cradle, and a handle, which are entirely conventional and are not explained in further detail.

It may be desirable to inspect the electrical terminal connection after a wire is installed into a terminal block and the terminal screw is secured. Thus, according to one or more embodiments, a line terminal barrier is provided that readily allows inspection of the terminal connection(s), such as electrical line wire connections to a line terminal(s). The portions of the line terminal barrier 5 may interface with one another to form one or more shielding apertures that are configured to receive the terminal wire (e.g., line wire) therein when the wire is connected to the electrical terminal. The portions interface with one another and are movable from one another so that at least one of the portions is readily movable to allow for a visual inspection of the electrical terminal connection. The line terminal barrier 5 may be configured to accommodate wire sizes between about #3 AWG to about 300 kcmil copper or aluminum wire, for example. The line terminal barrier 5 is operational to block off access to the stripped portion of the wire (e.g., a line-side wire otherwise referred to herein as a "line wire") and also to the one or more electrical terminals so that a user cannot come into contact with either the stripped portion of the wire or the electrical terminal.

While embodiments of the present invention have been disclosed in exemplary forms, it will be apparent to those skilled in the art that many modifications, additions, and deletions can be made therein without departing from the spirit and scope of the invention and its equivalents, as set forth in the following claims.

Embodiments and the various features and advantageous details thereof are explained more fully with reference to the non-limiting embodiments that are illustrated in the accompanying drawings and detailed in the following description. Descriptions of well-known starting materials, processing techniques, components and equipment are omitted so as not to unnecessarily obscure embodiments in detail. It should be understood, however, that the detailed description and the specific examples, while indicating preferred embodiments, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, article, or apparatus that comprises a list of elements is not necessarily limited to only those elements but may include other elements not expressly listed or inherent to such process, article, or apparatus.

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms.

In the foregoing specification, the invention has been described with reference to specific embodiments. However, one of ordinary skill in the art appreciates that various modifications and changes can be made without departing from the scope of the invention. Accordingly, the specification and figures are to be regarded in an illustrative rather than a restrictive sense, and all such modifications are intended to be included within the scope of invention.

Although the invention has been described with respect to specific embodiments thereof, these embodiments are merely illustrative, and not restrictive of the invention. The description herein of illustrated embodiments of the invention is not intended to be exhaustive or to limit the invention to the precise forms disclosed herein (and in particular, the inclusion of any particular embodiment, feature or function is not intended to limit the scope of the invention to such embodiment, feature or function). Rather, the description is intended to describe illustrative embodiments, features and functions in order to provide a person of ordinary skill in the art context to understand the invention without limiting the invention to any particularly described embodiment, feature or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Respective appearances of the phrases "in one embodiment," "in an embodiment," or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

It will also be appreciated that one or more of the elements depicted in the drawings/figures can also be implemented in a more separated or integrated manner, or even removed or rendered as inoperable in certain cases, as is useful in accordance with a particular application.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

What is claimed is:

1. A terminal barrier for covering an electrical terminal of an electrical switching apparatus having a housing, comprising:

a flexible portion that is configured to flexibly bend away from a rest position after the terminal barrier is installed;

a wall portion configured to surround the electrical terminal to block any access to the electrical terminal from one or more sides except an access for installation of a service line wire in the electrical terminal; and a snap portion for snapping in place around the electrical terminal to removably attach the terminal barrier to the housing of the electrical switching apparatus, wherein the flexible portion is configured to flexibly move to open up an access space that allows installation of a service line wire in the electrical terminal.

2. The terminal barrier of claim 1, wherein the wall portion having one or more openings to allow a free flow of air.

3. The terminal barrier of claim 1, wherein the snap portion is configured to interface with the flexible portion and the wall portion to form a shield configured for shielding around the service line wire extendable from the electrical terminal such that a finger-sized probe is not able to touch any live parts when the terminal barrier is installed and the electrical terminal is energized.

4. The terminal barrier of claim 1, wherein the wall portion includes:

first and second flexible arms to allow access to a set screw.

5. The terminal barrier of claim 4, wherein the wall portion further includes:

a cover with one or more ventilators and a plurality of grip ribs.

6. The terminal barrier of claim 5, wherein the wall portion further includes:

a U-shaped hold feature to latch on the electrical terminal.

7. The terminal barrier of claim 1, wherein the wall portion further includes:

first and second walls that flex-in and flex-out to allow installation of a service line wire.

8. The terminal barrier of claim 7, wherein the wall portion further includes:

first and second grips to open the terminal barrier from its top to allow installation of the terminal barrier before or after the service line wire is in place.

9. The terminal barrier of claim 8, the snap portion further includes:

first and second snapping legs to latch on to a boss of the housing of the electrical switching apparatus.

10. A terminal barrier for covering an electrical terminal of an electrical switching apparatus, comprising:

a flexible portion that is configured to flexibly move to open up an access space that allows installation of a service line wire in the electrical terminal;

a wall portion coupled to the flexible portion, the wall portion having one or more openings to allow free flow of air, wherein the wall portion is configured to surround the electrical terminal; and a snap portion coupled to the wall portion, the snap portion configured to removably snap in place around the electrical terminal, wherein the snap portion to interface with the flexible portion and the wall portion to form a shield configured for shielding around the service line wire extendable from the electrical terminal such that a finger-sized probe is not able to touch any live parts when the terminal barrier is installed and the electrical terminal is energized, wherein the wall portion includes first and second flexible aims to allow access to a set screw.

11. The terminal barrier of claim 10, wherein the wall portion further includes:

a cover with one or more ventilators and a plurality of grip ribs.

12. The terminal barrier of claim 11, wherein the wall portion further includes:

a U-shaped hold feature to latch on the electrical terminal.

13. The terminal barrier of claim 10, wherein the wall portion further includes:

first and second walls that flex-in and flex-out to allow installation of a service line wire.

14. The terminal barrier of claim 13, wherein the wall portion further includes:

first and second grips to open the terminal barrier from its top to allow installation of the terminal barrier before or after the service line wire is in place.

15. The terminal barrier of claim 14, the snap portion further includes:

first and second snapping legs to latch on to a boss of the housing of the electrical switching apparatus.

16. A method of covering an electrical terminal of an electrical switching apparatus having a housing with a line terminal barrier, the method comprising:

providing a flexible portion of the line terminal barrier that is configured to flexibly bend away from a rest position after the terminal barrier is installed;

providing a wall portion of the line terminal barrier configured to surround the electrical terminal to block any access to the electrical terminal from one or more sides except an access for installation of a service line wire in the electrical terminal; and providing a snap portion of the line terminal barrier for snapping in place around the electrical terminal to removably attach the terminal barrier to the housing of the electrical switching apparatus, wherein the snap portion to interface with the flexible portion and the wall portion to form a shield configured for shielding around the service line wire extendable from the electrical terminal such that a finger-sized probe is not able to touch any live parts when the terminal barrier is installed and the electrical terminal is energized, wherein the flexible portion is configured to flexibly move to open up an access space that allows installation of a service line wire in the electrical terminal and wherein the wall portion having one or more openings to allow a free flow of air.

17. The method of claim 16, wherein the snap portion to interface with the flexible portion and the wall portion to form a shield configured for shielding around the service line wire extendable from the electrical terminal such that a finger-sized probe is not able to touch any live parts when the terminal barrier is installed and the electrical terminal is energized.

* * * * *